US011499302B2

(12) United States Patent
Pfannschmidt

(10) Patent No.: US 11,499,302 B2
(45) Date of Patent: Nov. 15, 2022

(54) OUTLET DEVICE THAT CAN BE MOUNTED ON A WATER OUTLET

(71) Applicant: Neoperl GmbH, Mullheim (DE)

(72) Inventor: Holger Pfannschmidt, Geismer (DE)

(73) Assignee: Neoperl GmbH, Müllheim (DE)

( * ) Notice: Subject to any disclaimer, the term of this patent is extended or adjusted under 35 U.S.C. 154(b) by 741 days.

(21) Appl. No.: 16/326,790

(22) PCT Filed: Feb. 7, 2018

(86) PCT No.: PCT/EP2018/053062

§ 371 (c)(1),
(2) Date: Feb. 20, 2019

(87) PCT Pub. No.: WO2018/146140

PCT Pub. Date: Aug. 16, 2018

(65) Prior Publication Data

US 2021/0293009 A1 Sep. 23, 2021

(30) Foreign Application Priority Data

Feb. 8, 2017 (DE) ..... 102017102491.3

(51) Int. Cl.
*A45D 27/46* (2006.01)
*E03C 1/086* (2006.01)

(52) U.S. Cl.
CPC ..... *E03C 1/086* (2013.01); *A45D 27/46* (2013.01)

(58) Field of Classification Search
CPC ..... A45D 27/46
See application file for complete search history.

(56) References Cited

U.S. PATENT DOCUMENTS

| | | | |
|---|---|---|---|
| 4,838,949 | A | 6/1989 | Dugrot |
| 4,941,492 | A | 7/1990 | Morgan |
| 2014/0312253 | A1 | 10/2014 | Gan |

FOREIGN PATENT DOCUMENTS

| | | |
|---|---|---|
| DE | 202006004971 | 6/2006 |
| DE | 102009060433 | 6/2011 |

*Primary Examiner* — Jason Y Ko
(74) *Attorney, Agent, or Firm* — Volpe Koenig

(57) ABSTRACT

A device (1) for cleaning for example a single or multi-bladed wet razor head. The device includes a housing (2) which has a water through-flow opening (20) that can be mounted on an outlet of a sanitary outlet fitting. At least one mechanism (21) is arranged inside the housing (2) of the device (1) and is designed to generate at least one pulsating water jet and/or to increase the flow speed of the mains water exiting the outlet of the tap, and adjoins the water through-flow opening. The mains water is delivered to the mechanism (21) via several of the flow-cross sections of the channels (22*a*, 22*b*, 22*c*) defining the mains water exiting the outlet of the sanitary outlet fitting, this mechanism (21) being designed as a rotational valve which includes several blades (multi-bladed) which are arranged close to each other on a common axis (23) below at least one of the channels (22*a*, 22*b*, 22*c*), with blades guiding the mains water to the water outlet (24).

6 Claims, 2 Drawing Sheets

OUTLET DEVICE THAT CAN BE MOUNTED ON A WATER OUTLET

BACKGROUND

The present invention relates to an outlet device having a housing which at a water through-flow opening is attachable to a water outlet of a sanitary outlet fitting, wherein the water through-flow opening is adjoined by at least one mechanism which is disposed within the housing of the device and is configured for generating at least one pulsating water jet and/or for increasing the flow rate of the tap water exiting the water outlet of the outlet fitting.

It is known that wet razor blade heads can only be cleaned with great difficulty by via a usual water tap. The water jet exiting the water tap is too soft in order for sufficient cleaning to be achieved. This is inter alia due to the fact that the water jet is mixed with air by an aerated jet regulator, a so-called jet aerator.

Installations which attempt to solve this problem are already known from the prior art. DE 10 2009 060 433 A1 thus describes an attachment for an outlet of a water tap, said attachment being formed from a cap which has a slot that forms a flow opening from which the water exits.

A cleaning jet projector for domestic water taps which is disposed in a self-retaining manner on the outlet pipe or on the water jet aerator that is screwed to the latter is known from DE 20 2006 004 971 U1. Jet bores are disposed on the outlet of said cleaning jet projector, said jet bores being configured for generating water jets which can exert a cleaning effect without coinciding with the other, in each case neighboring, water jets so as to form one consolidated jet.

A device for cleaning a wet razor blade head is furthermore known from U.S. Pat. No. 4,838,949 A, said device comprising a flow opening that is directed into a chamber, wherein the tap water is projected by a deflection plate that is located in the chamber onto the wet razor blade head that is introducible into the chamber.

A device for rinsing a razor blade head is known from U.S. Pat. No. 4,941,492 A, said device being capable of being placed onto a water tap and receiving tap water at the line pressure. The device channels the tap water in order for the flow rate to be increased, so as to achieve therefrom a directed "high pressure" water jet for cleaning razor blades. The razor blade is introduced into a lower cavity of the device, where said razor blade is cleaned by the water jet with tap water which is directed under high pressure through a series of lines into the cavity.

The design that is to some extent complex in terms of construction on the one hand, and on the other hand the fact that these devices are largely unsuitable for generating a sufficient pressure for cleaning a wet razor blade head since the water jet from the water outlet herein permanently acts on the razor blades, or on the intermediate spaces, which has the effect that the shaved beard stubbles are wedged more deeply in the intermediate spaces and are trapped therein, are disadvantageous in the aforementioned devices. The cross section of the impacting water jet, despite the proposed construction, is still so large that the beard stubbles can barely escape. Moreover, the jet pressure and the jet velocity in the case of the known installations has to be considered mediocre.

SUMMARY

The present invention is based on the object of achieving a device which eliminates the aforementioned problems and which is suitable for permitting a plurality of water jets, in particular cleaning jets, that are small in the cross section to pulsate in an alternating manner, for example across the longitudinal face of a razor blade.

The above object is achieved with a device having one or more features according to the invention. Advantageous design embodiments and refinements of the device according to the invention are set forth in the dependent claims.

Alluding to the mentioned prior art, the device according to the invention comprises a housing which comprises which is attachable by a water through-flow opening thereof to an outlet of a water tap, said water through-flow opening being adjoined by at least one mechanism which is disposed within the housing of the device and is configured for generating at least one pulsating water jet and/or for increasing the flow rate of the tap water exiting the outlet of the water tap.

A device of the type mentioned at the outset is characterized according to the invention in that the mechanism is supplied tap water by way of a plurality of channels that delimit the flow cross section of the tap water exiting the outlet of the water tap, wherein the mechanism is configured as a rotary valve which comprises a plurality of blades which are disposed on a common axle beside one another below in each case at least one channel and which direct the tap water to a water outlet.

Further objectives, features, advantages, and potential applications of the device according to the invention are derived from the description hereunder of an exemplary embodiment by means of the drawing. Here, all of the features described and/or illustrated in the figures form the subject matter of the invention individually or in any desired combination, even independently of how they are combined in individual claims or their dependency references.

DETAILED DESCRIPTION

Figure 1:
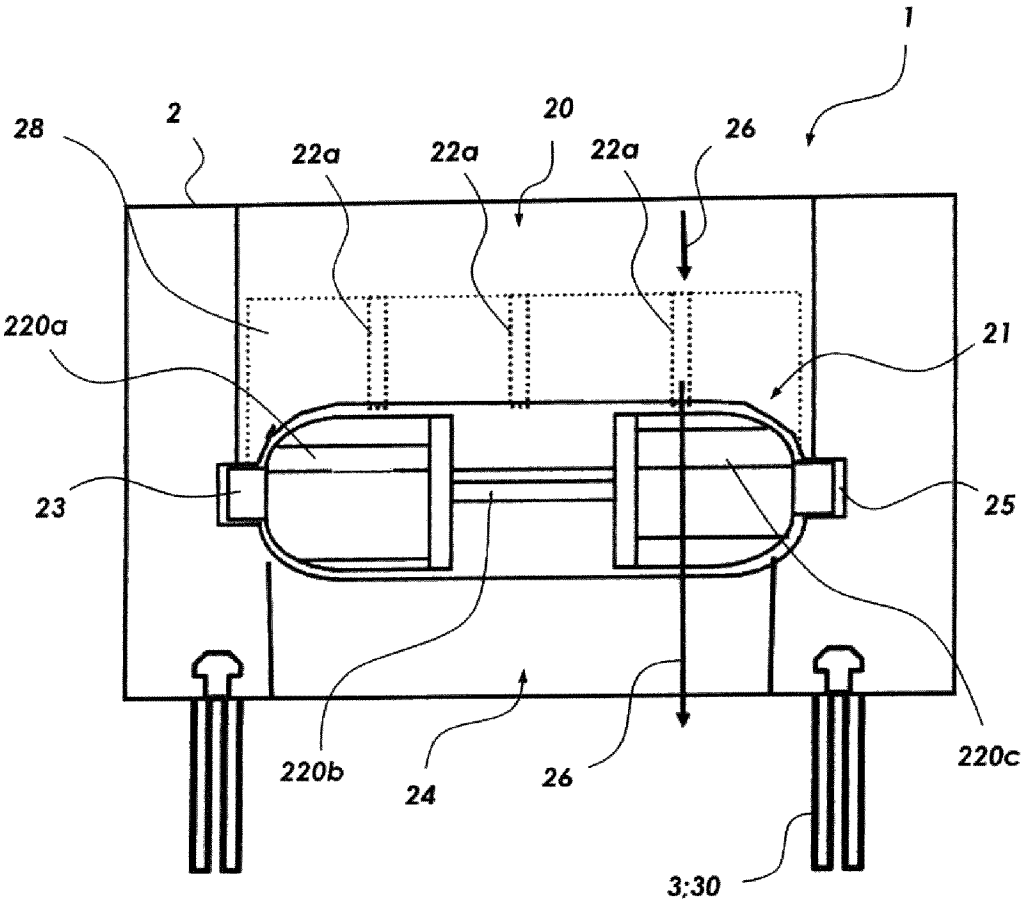
FIG. 1 shows the device according to the invention in a schematic sectional lateral view.
Figure 2:
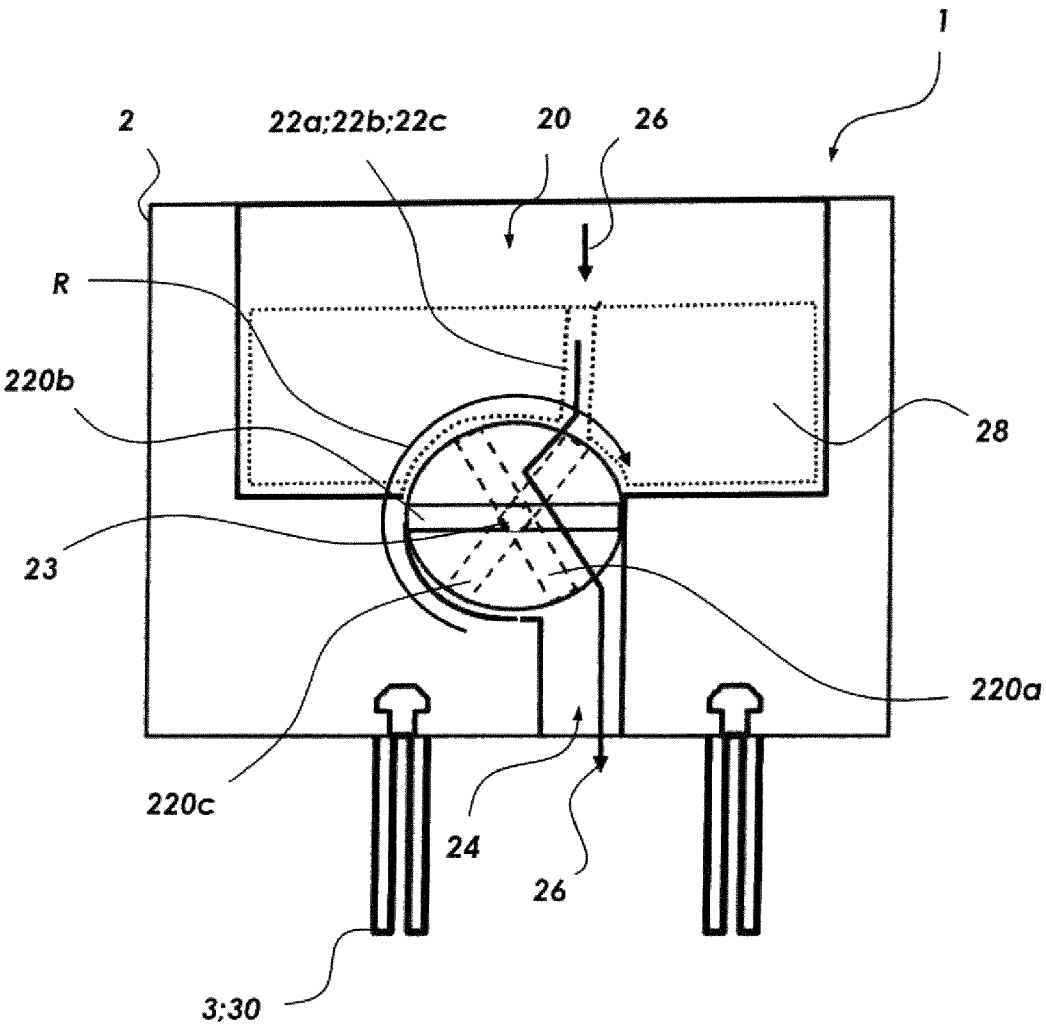
FIG. 2 shows the device in the frontal view.

As can be seen from FIG. 1, the device according to the invention, which here is also referred to as the outlet device, comprises at least one mechanism 21 which is configured for generating a pulsating water jet and/or for increasing the flow rate of the tap water exiting the outlet of the water tap. This mechanism 21 is advantageously configured such that the prevailing water pressure when opening the water tap is directed through a channel plate 28 having a plurality of channels 22*a*, 22*b*, 22*c* (bores) in one row, said channels 22*a*, 22*b*, 22*c* opening onto the rotary valve. As can be seen from FIG. 1 and FIG. 2, the device 1 furthermore comprises at least one water outlet 24.

As can be seen from FIG. 1, the blades 220*a*, 220*b*, 220*c* are disposed so as to be mutually offset at a defined angle on the axle 23.

The axle 23 conjointly with the blades 220*a*, 220*b*, 220*c* by means of the tap water exiting from the at least one respective channel 22*a*, 22*b*, 22*c* of the water tap is set in rotation by at least one blade 220*a*, 220*b*, 220*c*.

The arrangement of the blades 220*a*, 220*b*, 220*c* is most particularly advantageously conceived in such a manner that the tap water of at least one channel 22*a*, 22*b*, 22*c*, depending on the rotary position of the blades 220*a*, 220*b*, 220*c*, is either retained by at least one blade 220*a*, 220*b*, 220*c*, or on at least one blade 220*a*, 220*b*, 200*c* flows to a water outlet 24.

The blades 220*a*, 220*b*, 220*c* in terms of the angle thereof are disposed so as to be mutually offset on the axle 23 in such a manner that, independently of the respective rotary position of the blades 220*a*, 220*b*, 220*c*, at least one blade 220*a*, 220*b*, 220*c* prevents a throughflow of the tap water from at least one channel.

Due to the tap water flowing in an alternating manner on the rotating blades 220*a*, 220*b*, 220*c* a pulsating water jet having a water pressure that is provided so as to depend on the design embodiment of the diameter of the channels 22*a*, 22*b*, 22*c* is created.

As can be seen from FIG. 1, the device 1 has at least one bearing device 25 for a rotatable mounting of the axle 23 in the housing 2.

It is furthermore advantageous for a splash protector 3 to be provided on the water outlet 24, said splash protector 3 being formed from ribs 30 that are vertically aligned and configured so as to be flexible and/or elastic as well as chamber-like. The splash protector 23 is preferably disposed in an annular groove 31 on the housing chamber 2*b*.

The device according to the invention in terms of the embodiment thereof is not limited to the preferred embodiments set forth above. Rather, a multiplicity of variations of design embodiments which, even in the case of a fundamentally different embodiment, utilize the solution illustrated are conceivable.

In summary, the following is therefore to be noted:

The present invention relates to a device (1) for cleaning, for example, a single-blade or multi-blade wet razor blade head, having a housing (2) which comprises a water through-flow opening (20) that is attachable to an outlet of a sanitary outlet fitting, said water through-flow opening (20) being adjoined by at least one mechanism (21) which is disposed within the housing (2) of the device (1) and is configured for generating at least one pulsating water jet and/or for increasing the flow rate of the tap water exiting the outlet of the water tap. The device according to the invention is characterized in that the mechanism (21) is supplied tap water by way of a plurality of channels (22*a*, 22*b*, 22*c*) that delimit the flow cross section of the tap water exiting the water outlet of the sanitary outlet fitting, wherein the mechanism (21) is configured as a rotary valve which comprises a plurality of blades (multi-blade) which are disposed on a common axle (23) beside one another below in each case at least one channel (22*a*, 22*b*, 22*c*) and which direct the tap water to a water outlet (24).

LIST OF REFERENCE SIGNS

1 Device
2 Housing
3 Splash protector
20 Water through-flow opening
21 Mechanism
22*a*, 22*b*, 22*c* Water-directing channels
23 Axle
24 Water outlet
25 Bearing device
26 Tap water
28 Channel plate
30 Ribs
220*a*, 220*b*, 220*c* Blades
R Rotation direction

The invention claimed is:

1. A device (1), comprising:

a housing (2) which having a water through-flow opening (20) that is adapted to be attached a water outlet of a sanitary outlet fitting, a mechanism (21) that adjoins the water through-flow opening (20) disposed within the housing (2), the mechanism (21) is configured for at least one of generating at least one pulsating water jet or increasing a flow rate of tap water exiting the water outlet of the sanitary outlet fitting, a plurality of channels (22*a*, 22*b*, 22*c*) located in the housing (2) that are configured to delimit a flow cross section of the tap water exiting the outlet of the water tap and direct the tap water to the mechanism (21), and the mechanism (21) comprises a rotary valve including a plurality of blades (220*a*, 220*b*, 220*c*) which are disposed on a common axle (23) beside one another below in each case at least one of the plurality of channels (22*a*, 22*b*, 22*c*) and which are configured to direct the tap water to a housing water outlet (24).

2. The device (1) as claimed in claim 1, wherein the blades (220*a*, 220*b*, 220*c*) are arranged mutually offset at a defined angle on the axle (23), and the axle (23) is rotatable conjointly with the blades (220*a*, 220*b*, 220*c*) by the tap water exiting from the at least one respective one of the channels (22*a*, 22*b*, 22*c*) contacting at least one of the blades (220*a*, 220*b*, 220*c*).

3. The device (1) as claimed in claim 2, wherein in dependence upon a rotary position of the blades (220*a*, 220*b*, 220*c*), the tap water of at least one said channel (22*a*, 22*b*, 22*c*), is either retained by at least one said blade (220*a*, 220*b*, 220*c*), or flows on at least one said blade (220*a*, 220*b*, 200*c*) to the housing water outlet (24).

4. The device (1) as claimed in claim 2, wherein the blades (220*a*, 220*b*, 220*c*) in terms of the angle thereof are disposed so as to be mutually offset on the axle (23) in such a manner that, independently of a respective rotary position of the blades (220*a*, 220*b*, 220*c*), at least one said blade (220*a*, 220*b*, 220*c*) prevents a throughflow of the tap water from at least one said channel.

5. The device (1) as claimed in claim 1, further comprising at least one bearing (25) for rotatable mounting of the axle (23) in the housing (2).

6. The device (1) as claimed in claim 1, wherein the device is adapted for cleaning a single-blade or multi-blade wet razor blade head.

* * * * *